United States Patent [19]

Ostlinning et al.

[11] Patent Number: 4,475,372

[45] Date of Patent: Oct. 9, 1984

[54] METHOD AND MEANS FOR REMOVING A DIE, SEALING MEMBER AND RESIDUAL METAL FROM AN INDIRECT EXTRUSION PRESS

[75] Inventors: Günter Ostlinning, Düsseldorf; Otto A. Roever, Haan; Günther Wintzen; Franz J. Zilges, both of Monchen-Gladbach, all of Fed. Rep. of Germany

[73] Assignee: SMS Schloemann Siemag Aktiengesellschaft, Düsseldorf, Fed. Rep. of Germany

[21] Appl. No.: 356,798

[22] Filed: Mar. 10, 1982

[30] Foreign Application Priority Data

Mar. 16, 1981 [DE] Fed. Rep. of Germany ..... 3110105

[51] Int. Cl.[3] ..... B21C 35/00; B21C 35/04

[52] U.S. Cl. ..... 72/255; 72/263; 72/273.5

[58] Field of Search ..... 72/255, 263, 273.5, 72/272

[56] References Cited

U.S. PATENT DOCUMENTS 1,609,988 12/1926 Bull ..... 72/255
3,530,702 9/1970 De Ridder ..... 72/255
4,154,081 5/1979 Boshold ..... 72/273.5

FOREIGN PATENT DOCUMENTS 35540 10/1976 Japan ..... 72/273.5
35541 10/1976 Japan ..... 72/273.5
69135 10/1977 Japan ..... 72/273.5
112257 9/1978 Japan ..... 72/255

*Primary Examiner*—Lowell A. Larson
*Attorney, Agent, or Firm*—Holman & Stern

[57] ABSTRACT

An indirect extrusion press has a die and die holder 20 and a sealing plate to close the billet carrier. After extrusion, a one-piece or two-part holding sleeve is placed between the sealing plate and the sealing stem and the latter is advanced to push the billet carrier over the die stem thereby expelling the sealing plate, the butt end of the billet, and the die holder into the sleeve. A shearing device then shears off the sealing plate and butt end, the second part of the holding sleeve moving aside with the sealing plate and butt end in it. The die holder is clamped in the holding sleeve which is pulled away from the billet carrier to separate the die from the extruded product. In the case of a one-piece holding sleeve, a transverse aperture is provided to allow the shearing operation.

11 Claims, 13 Drawing Figures

Figure 1:
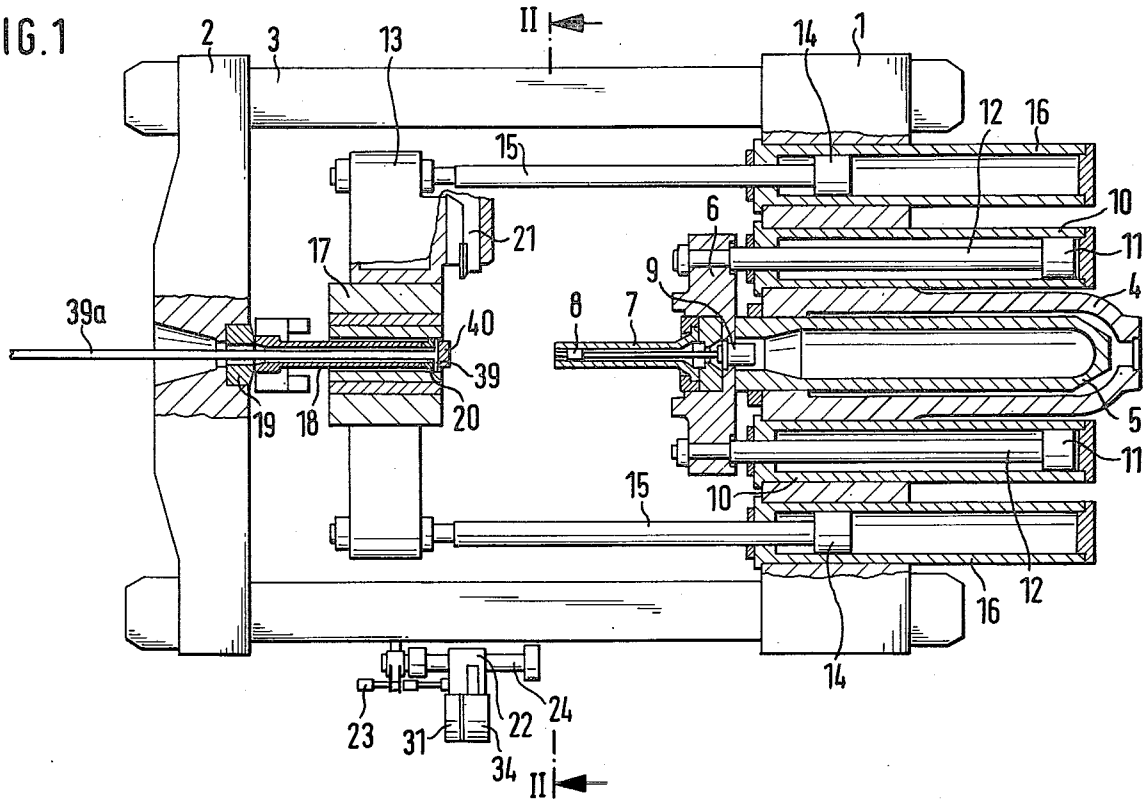

METHOD AND MEANS FOR REMOVING A DIE, SEALING MEMBER AND RESIDUAL METAL FROM AN INDIRECT EXTRUSION PRESS

The invention relates to an operating method for freeing the die, butt end and sealing plate from the press billet carrier, for shearing off the butt end and sealing plate and for pulling or pushing out the extruded piece, in indirect metal extrusion presses after the extrusion operation, and arrangements for carrying out the operating method.

After the extrusion operation has terminated and the load on the press has been released, it is necessary to free the sealing plate, the butt end and the die to allow the subsequent shearing-off of the butt end. The necessary maximum force for this is about 25% of the press force. The billet carrier shifting arrangement has had to be designed for this force.

In addition, in order to prevent inclusions and in order to obtain good pipe tolerances when extruding pipes, exact centering of the die stem, billet carrier and sealing stem with respect to the moving crosshead is necessary. However, this exact centering can be impaired during the shearing-off of the butt end. In addition, in order to subsequently pull the extruded piece out of the die after shearing off the butt end, a force is necessary which depends on the dimensions of the product and the product quality and is also influenced by the preceding shearing operation, so that under certain circumstances it can reach several tons. If the extruded piece is to be pulled out through the press outlet using a puller, this puller would have to be designed with a drive to accommodate this high pulling force.

Instead of pulling the extruded piece out of the die, it can also be pushed out using an expulsion mandrel. However, using this operating method the cycle time of the press is considerably lengthened, as the sealing stem with its internal expulsion mandrel cannot be returned to its initial position during the preceding shearing operation. Using this method of operation, not only the die but also the expulsion mandrel must be changed at each programme change.

The object of the invention is therefore to provide a new operating method for carrying out the necessary steps after the extrusion operation, and to provide correspondingly satisfactory arrangements for carrying out this method, whereby the aforesaid drawbacks are obviated.

This object is attained according to the invention by the following operational steps:

In order to free the die, butt end and sealing plate from the bore in the billet carrier, the billet carrier is pressed over the die stem in the direction of the press counter platen, using the available force of the feed and/or main press cylinder, by means of the sealing stem disposed on the moving crosshead of the press, after having interposed one or two series-disposed holding sleeves for the die, butt end and sealing plate, and which are respectively closed at the sealing stem end.

Secondly, after the die, butt end and sealing plate have been received in the holding sleeve or sleeves, a shearing device disposed on the billet carrier holder is pressed against the butt end and sealing plate perpendicular to the press axis either by way of a holding sleeve provided transversely to the press axis with an opening having the width of the sealing plate, or by way of one of the two holding sleeves movably provided on the removal arm, the shearing reaction force being absorbed at the billet carrier holder by way of the holding sleeves.

Thirdly, after the shearing operation, in order to pull the extruded piece out of the die, the removal arm is moved against the pressing direction by means of adjustable power cylinder-piston units disposed on the removal arm and bearing on the front end of the billet carrier, while the die holder is clamped in the holding sleeve and the extruded piece is held firmly at the press discharge end.

Thus, the force of the feed and/or main press cylinder can be used for freeing the die, butt end and sealing plate located in the billet carrier bore after the extrusion operation, and for sliding them into the holding sleeves, by stripping the billet carrier over the die stem, without the sliding force for the billet carrier needing to be made large. Moreover, the separation of the tools located in the holding sleeves by means of the shearing device disposed on the billet carrier holder can take place without the shearing force disadvantageously affecting the central position of the die stem, billet carrier etc., because the shearing reaction force acts directly on the billet carrier holder by way of the holding sleeves provided on the removal arm, i.e. a closed force system exists.

Now in order to be able to pull the extruded piece out of the die after shearing off the butt end and sealing plate, the extruded piece is released in simple manner by axially moving the removal arm with its holding sleeves against the pressing direction by means of the power cylinder-piston unit or units, after firmly holding the extruded piece at the press discharge end and clamping the die holder holding the die inside the holding sleeve.

In order to carry out the operating method in an indirect metal extrusion press, this press comprises a press frame in the form of a press cylinder-supporting cylinder crosshead, a counter platen and tension members which connect these latter together, a hollow stem carrying at its front end a die and supported on the counter platen, an axially displaceable billet carrier holder supporting a billet carrier and guided in the press frame and having disposed on the cylinder crosshead end thereof a shearing device which acts perpendicular to the press axis, and further comprises a press piston which slides in the press cylinder and is connected to a moving crosshead guided in the press frame, the moving crosshead carrying a sealing stem which seals the billet carrier, and means being provided for inserting and removing tools such as the die and sealing plate; according to the invention, the arrangement for carrying out the operating method in this press is characterised in that a removal device is provided in the form of an arm the free end of which can be swivelled into the press axis and which is slidable parallel to the press axis, its free end carrying a holding sleeve disposed in the pressing direction for holding the die holder with its die, the butt end and the sealing plate, the holding sleeve being either in a single piece with an opening transverse to the press axis and having the width of the sealing plate, or in two parts, in this latter case the part at the sealing stem end being mobile transversely to the press axis, both the one-piece sleeve and that part of the two-part sleeve fixed to the arm comprising a support which rests on a bracket on the billet carrier holder, and both the one-piece sleeve and the mobile part of the two-part sleeve being closed at that end facing the sealing stem.

By means of the removal arm which can be swivelled in between the billet carrier and sealing stem, and which comprises at its free end a holding sleeve or sleeves which are closed at their sealing stem end, it is possible in a simple manner, by means of the sealing stem and the feed or main press force which is available therethrough, to strip the billet carrier by way of the die stem so that the die holder with the die, butt end and sealing plate slide into the holding sleeves. The billet carrier shifting arrangement can therefore be smaller, and designed only for the force necessary for the shifting operation. Shorter idle periods and thus a quicker pressing operation are possible.

According to a further characteristic of the invention, the support disposed on the holding sleeve is adjustable in level. By this means, the holding sleeve can always be set centrally to the press axis for the shearing operation.

According to a further characteristic of the invention, a clamping device is associated with the holding sleeve which receives the die holder. This clamps the die holder together with its die after these have been slid in, for the purpose of shearing off the butt end and for pulling out the extruded piece after the shearing operation.

According to a further characteristic of the invention, the mobile holding sleeve disposed on the removal arm is made either slidable or swivel-mounted on the arm itself. By this means, the sleeves which receive the butt end and sealing plate are able to withdraw under the shearing pressure. The butt end and sealing plate can easily be fed to a separation device.

The one-piece holding sleeve fixed to the removal arm advantageously comprises in its periphery a through opening transversely to its axis, and which corresponds to the diameter of the sealing plate and at least the depth of the butt end and sealing plate. A yieldable catching device for the butt end and sealing plate can be provided below this opening.

According to a further advantageous characteristic of the invention, after clamping the die holder in the holding sleeve and after the shearing operation, the removal arm is slidable opposite the pressing direction while firmly holding the extruded piece at the press discharge end in order to free the extruded piece, there being disposed on the removal arm, at the level of the billet carrier, hydraulic power cylinder-piston units of which the adjustable-force pistons become supported, on being loaded, against that end of the billet carrier which faces the moving crosshead of the press.

In this manner, the end of the extruded piece can be released and extracted from the die by moving the removal arm with the clamped die, without a special pulling device having to be over-sized in terms of its force. Another method of removing the extruded piece can advantageously be attained in that the closed end of the holding sleeve facing the sealing stem is provided with a central bore through which a known expulsion device disposed in the press or sealing stem pushes the extruded piece out of the die after its shearing-off.

Figure 2:
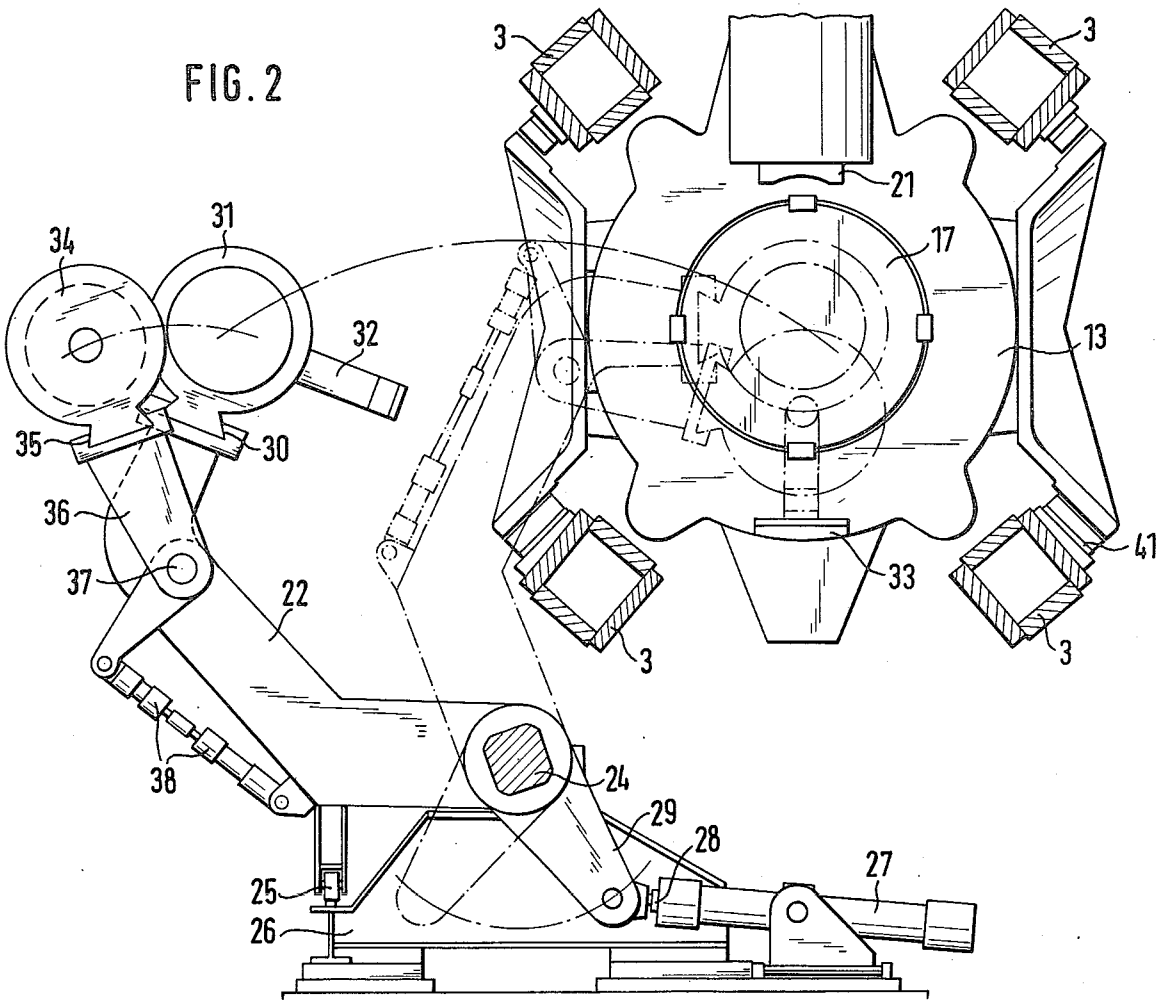
Figure 3:
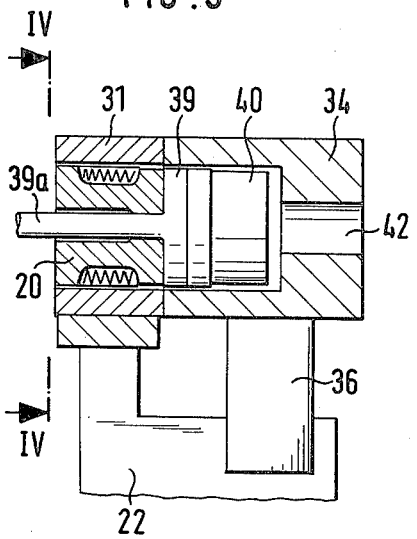
Figure 4:
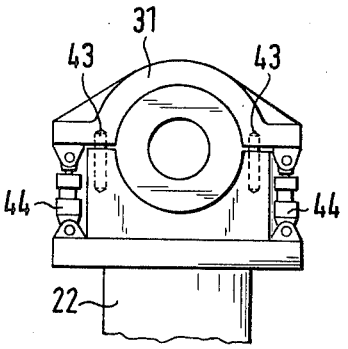
Figure 5:
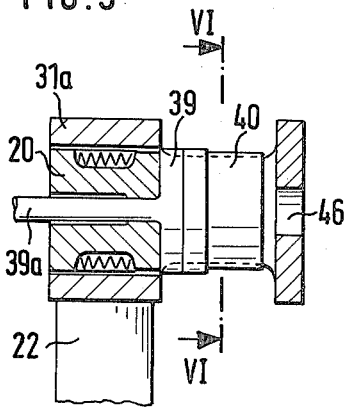
Figure 6:
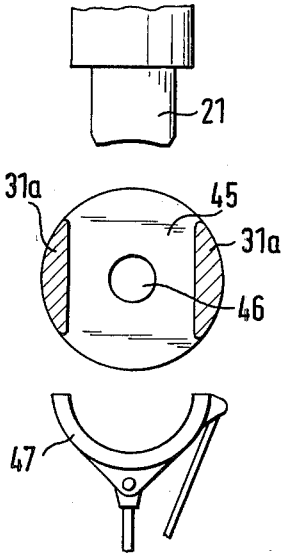
Figure 7:
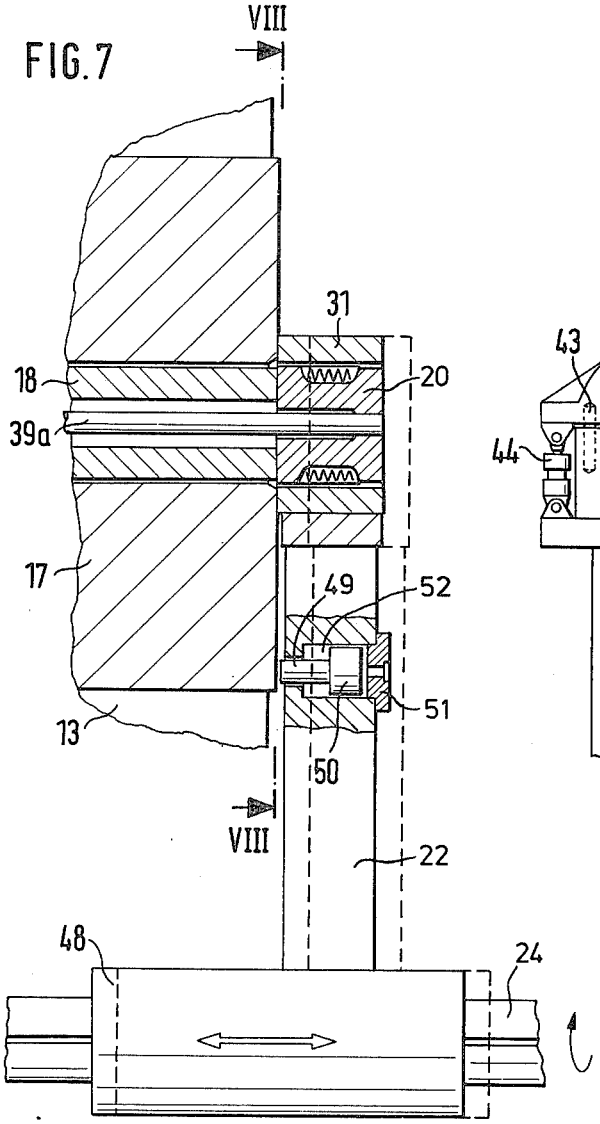
Figure 8:
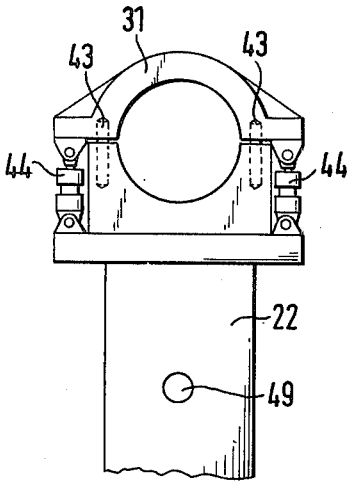

One embodiment of the invention is described in detail hereinafter with reference to the drawings, in which:

FIG. 1 is a diagrammatic illustration of an indirect metal extrusion press,

FIG. 2 is a cross-section through the press on the line II—II of FIG. 1, with partly mobile holding sleeves disposed on a removal arm, FIG. 3 is a longitudinal section through the holding sleeves, FIG. 4 is a transverse view of the holding sleeve fixed to the removal arm, taken on the line IV—IV of FIG. 3, FIG. 5 is a longitudinal section through a one-piece holding sleeve for receiving the die holder with its die, the butt end and sealing plate, FIG. 6 is a cross-section through the one-piece holding sleeve on the line VI—VI of FIG. 5, FIG. 7 is a longitudinal section through the billet carrier and die stem, showing the holding sleeve fixed on the removal arm, and a power cylinder-piston unit disposed on the removal arm and with its piston supported against the billet carrier, FIG. 8 is a side view of the holding sleeve fixed to the removal arm, taken on the line VIII—VIII of FIG. 7.

Figure 9A:
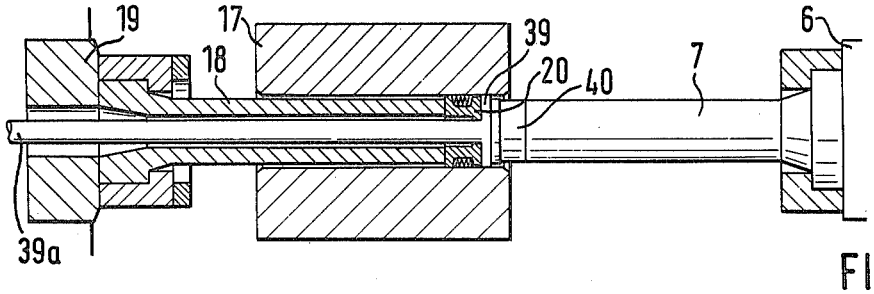
Figure 9B:
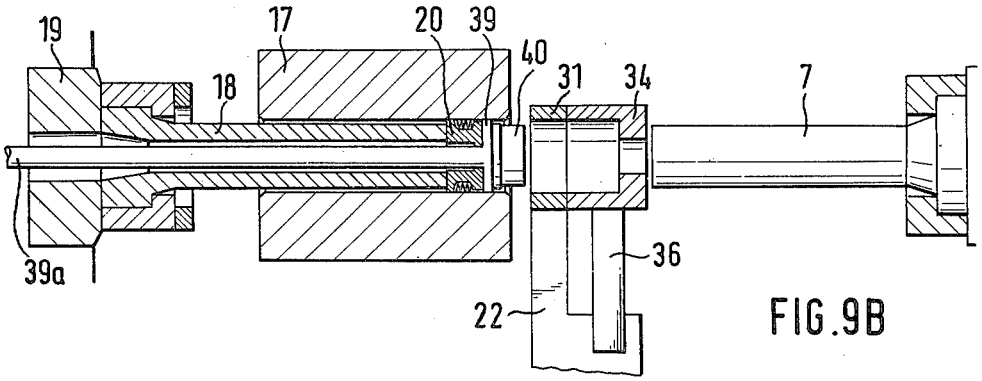

The method of operation of the indirect metal extrusion press after the end of the extrusion operation is illustrated diagrammatically hereinafter in the form of sketches, the various operating positions being indicated as follows:

FIG. 9*a* End of the extrusion operation,

FIG. 9*b* Return of the moving crosshead with its sealing stem, and the swivelling of the removal arm with its holding sleeves into the press axis.

Figure 9C:
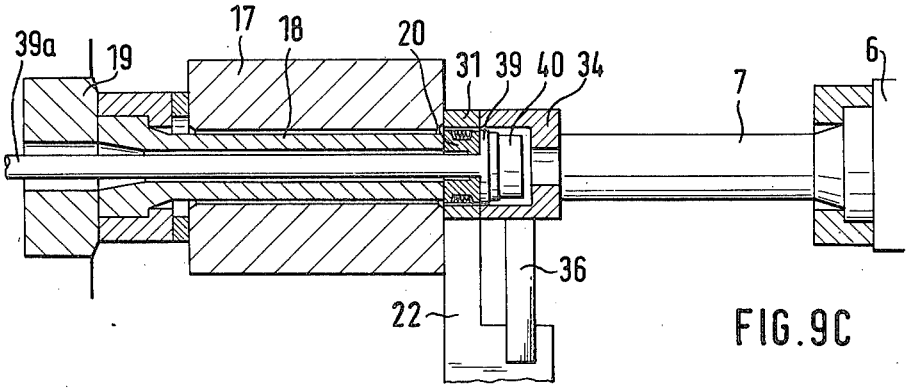
Figure 10A:
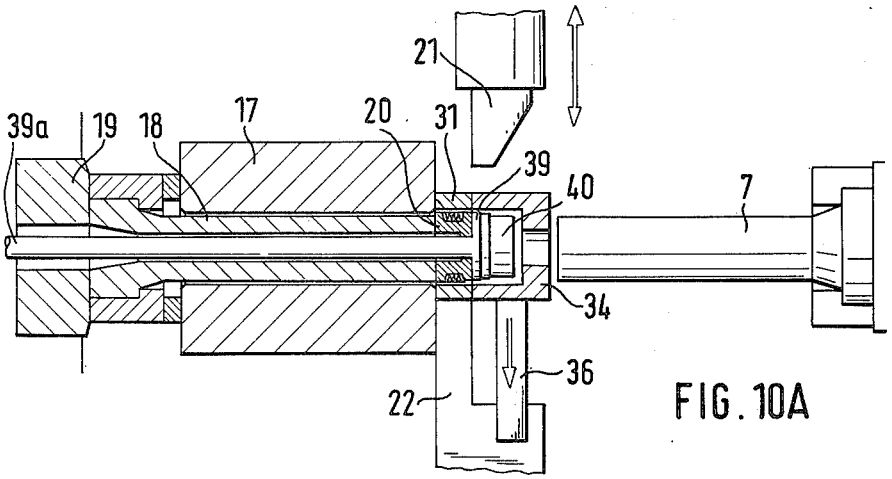
Figure 10B:
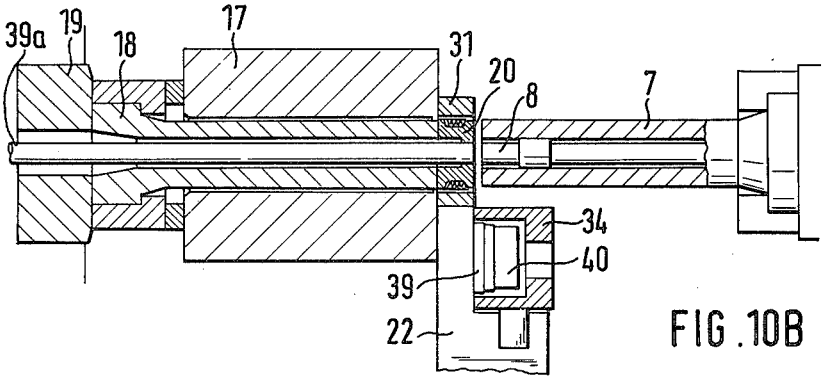

FIG. 9*c* Forward movement of the moving crosshead, thus stripping the billet carrier as the removal arm and billet carrier move forward, FIG. 10*a* Shearing the butt end and sealing plate while the outer holding sleeve slides or swivels, FIG. 10*b* Shearing operation terminated when holding sleeve swivelled outwards, with butt end and sealing plate sheared off.

The indirect metal extrusion press shown in FIG. 1 consists of a press frame formed from a cylinder crosshead 1, a counter platen 2 and tie members 3 which connect these together. In the cylinder crosshead 1 there is disposed a main press cylinder 4, in which a main press piston 5 slides. This is connected to a moving crosshead 6, which carries a sealing stem 7 on that side facing the counter platen 2. An expulsion mandrel 8 slides centrally in the sealing stem 7, and is connected to a hydraulic expulsion and return device 9. A further two feed and return cylinders 10 are also provided in the cylinder crosshead 1, symmetrically about the main press cylinder 4. The pistons 11 which slide in them are in the form of differential pistons, and are fixed by means of their piston rods 12 to the moving crosshead 6.

A billet carrier holder 13 is mobile axially along the tie members 3 in the press frame, and is moved by pistons 14 which are connected by way of piston rods 15 to the billet carrier holder 13. The pistons 14 slide in cylinders 16, which are likewise disposed in the cylinder crosshead 1. The billet carrier holder 13 holds a billet carrier 17.

To the counter platen 2 there is fixed a hollow die stem 18, which is supported thereat by way of a pressure plate 19 and at its free end carries a die holder 20 with its die, with which it presses during the pressing operation into the bore of the billet carrier 17 which travels over it. A shearing device 21 acting perpendicular to the press axis is disposed on the billet carrier holder 13. The construction and operation of the press correspond to the state of the art.

Outside the press frame there is disposed a special removal arm 22 which is slidable parallel to the press axis, and can be swivelled onto the press axis so that its free end comes between the billet carrier holder 13 and the withdrawn sealing stem 7. The sliding parallel to the press axis is obtained by means of a hydraulic piston-cylinder unit 23. The removal arm 22 can be swivelled into the press axis by means of a square shaft 24 (FIG. 2), on which it can slide parallel to the press axis.

FIG. 2 shows a cross-section through the press on the line II—II of FIG. 1 to an enlarged scale. When in its initial position, the removal arm 22 is supported by way of a roller 25 on a subframe 26, which also serves for supporting the square shaft 24. A hydraulic cylinder 27 swivel-mounted on the subframe 26 urges the removal arm 22 such that its free end moves in the direction of the press axis, by means of a lever 29 fixed rigidly on to the square shaft 24 and hinged to the piston 28 of the hydraulic cylinder.

A holding sleeve 31 for receiving the die holder 20 with its die is replaceably fixed in guides 30 to the free end of the removal arm 22. The holding sleeve 31 carries a support 32 which when the removal arm 22 has been swung in, rests against a bracket 33 which is fixed to the lower part of the billet carrier holder 13. The support 32 is adjustable in level.

A second holding sleeve 34 is fixed by guides 35 to one of the free ends of an angle lever 36 which can be swivelled perpendicular to the press axis by way of a pivot pin 37 on the removal arm 22. By means of a hydraulic or pneumatic cylinder-piston unit 38 which is hinged at one end to the lower region of the removal arm 22 and is pivoted at its other end to the other free end of the angle lever 36, the second holding sleeve 34 for containing the butt end 39 and a sealing plate 40 disposed in front of the sealing stem 7 can either be fixed in the press axis aligned with the other holding sleeve 31, or swivel yieldably downwards under the shearing pressure of the shearing device 21. The position of the removal arm 22 when swung into the press axis is shown by a dashed and dotted line in FIG. 2. Also shown here is the guide system for the billet carrier holder 13 on guide tracks 41 disposed on the tie members 3.

FIG. 3 is a longitudinal section through the holding sleeve 31 which is fixed on the removal arm 22 and holds the die holder 20 with its die after the stripping operation. On the same axis there lies the second holding sleeve 34, which is pivoted on the removal arm 22 by way of the angle lever 36, so that it is either directly adjoining or to the rear of the holding sleeve 31. In this position, the holding sleeve 34 has received the butt end 39 and sealing plate 40 in its interior. The extruded piece 39*a* is here still joined to the butt end 39 before the shearing operation. The second holding sleeve 34 is closed at the end facing the sealing stem 7. It affords in this position only a bore 42 through which the butt end 39 and sealing plate 40 can be pushed out after the shearing operation and after being swivelled out of the press axis.

FIG. 4 is a view of the holding sleeve 31 taken on the line IV—IV of FIG. 3. The holding sleeve 31 is divided longitudinally in order to be able to firmly hold the die holder 20 and die which have been received therein, as required for the shearing operation and for later pulling or pushing the extruded piece out. The two sleeve halves are held in their central position by means of guide rods 43, and are pulled towards each other by means of hydraulic power cylinder-piston units 44 in order to clamp the die holder 20.

In contrast to FIG. 3, FIG. 5 shows a one-piece holding sleeve 31*a* for containing the die holder 20 with its die, the butt end 39 and sealing plate 40 after the billet carrier 17 has been stripped by way of the die stem 18. To enable the butt end 39 and sealing plate 40 to be sheared from the extruded piece 39*a* by means of the shearing device 21, the holding sleeve 31*a* comprises, in a position corresponding with the shearing device 21, a through opening 45 having a size equal to the diameter of the sealing plate 40 and extending transversely to the press axis. As in the case of the mobile holding sleeve 31, the end facing the sealing stem 7 is closed as far as a central bore 46, through which the extruded piece 39*a* can be pushed out of the die by means of the expulsion device 8 after the butt end 39 and sealing plate 40 have been sheared off. The opening 45 is shown clearly in FIG. 6 as a section taken on the line VI—VI of FIG. 5, but without the butt end 39 and sealing plate 40. A yieldable catching device 47 is provided for the sheared-off butt end 39 and sealing plate 40 below the one-piece holding sleeve 31*a*. The one-piece holding sleeve 31*a* also comprises exactly the same device as the holding sleeve 31 for clamping the die holder 20 as required for shearing off the butt end 39 and later for pulling or pushing the extruded piece 39*a* out of the die.

FIG. 7 shows a portion of the billet carrier 17 with the die stem 18, and the removal arm 22 with the holding sleeve 31 fixed thereon, and showing the die holder 20 with the extruded piece 39*a* still in the die. The removal arm 22 is slidable along the square shaft 24 by way of a sliding sleeve 48. Instead of pulling the extruded piece 39*a* out of the die by means of a puller at the press discharge end, which would involve a larger force, in this case, as also shown in FIG. 8 in section on the line VIII—VIII, the die holder 20 is clamped against axial sliding in the holding sleeve 31 by means of the hydraulic power cylinder-piston units 44. A hydraulic cylinder 52 provided in the middle of the removal arm 22 pushes by means of the piston rod 49 of its differential piston 50 against the front end of the billet carrier 17. On applying a pressure medium to the piston 50 by way of the seal plate 51 which seals the cylinder 52 outwards, the removal arm 22 slides towards the right in the direction of the arrow to the position shown in broken lines, whereupon the holding sleeve 31 with the die holder 20 clamped therein also moves towards the right. As the extruded piece 39*a* is held firmly at the press discharge end, not shown, the extruded piece 39*a* is thus pulled out of the die.

The method of operating the press following the extrusion process is illustrated in FIGS. 9*a* to 9*c* and 10*a* to 10*b*, as follows:

In FIG. 9*a*, the extrusion process has terminated. The sealing stem 7 lies with its sealing plate 40 against one side of the butt end 39, and the die stem 18 and die holder 17 with its die on the other side of the butt end 39 lie in the bore inside the billet carrier 17.

In FIG. 9*b* the moving crosshead 6 with the sealing stem 7 has withdrawn. The removal arm 22 with the holding sleeves 31 and 34 has been swivelled into the press axis between the sealing stem 7 and billet carrier 17.

In FIG. 9*c*, the so-called stripping has taken place. For this purpose, the sealing stem 7 pushes by means of the force of the feed and/or main press cylinder 10, 4 against the holding sleeves 34 and 31, which in their turn rest against the billet carrier 17, and shift this latter until it rests against the counter platen 2. By this means, the sealing plate 40 and butt end 39 are slid into the holding sleeve 34, and the die holder 20 with its die is slid into the holding sleeve 31.

In FIG. 10*a*, the butt end 39 and sealing plate 40 are sheared from the extruded piece 39*a* in front of the die while the die holder 20 is clamped in the holding sleeve 31. During this, the holding sleeve 34 with the butt end 39 and sealing plate 40 swivels outwards under the action of the shearing pressure. The sealing stem 7 is moved slightly backwards after the stripping operation.

In FIG. 10*b* the shearing operation has ended. The sealing stem 7 has been moved forward as far as the holding sleeve 31, and with the die holder 20 firmly clamped again in the holding sleeve 31 the device or expulsion mandrel 8 pushes the extruded piece 39*a* out of the die.

We claim:

1. In an indirect extrusion press which comprises a press frame constituted by a cylinder crosshead, a counter-platen and tie members interconnecting this crosshead and counter-platen, a billet carrier holder mounted for movement in the axial direction of the press frame, a billet carrier carried by the said holder, a movable crosshead mounted between the cylinder crosshead and the billet carrier holder and movable in the axial direction, a hollow die stem mounted on the counter-platen, extending towards the billet carrier and having a tip adapted to locate a die holder and extrusion die in the billet carrier, a sealing stem mounted on the moving crosshead, extending towards the billet carrier and having a tip adapted to locate a sealing plate in the billet carrier, at least one cylinder mounted on the cylinder crosshead with a piston movable in the cylinder for moving the movable crosshead, and means for moving the billet carrier holder, the improvement comprising: a shaft parallel to the axis of the press, and removal arm pivotable about said shaft and having a free end which by pivoting of the arm is movable to and away from the axis of the press, the arm being mounted for sliding independently on said shaft parallel to the press axis; a shearing device mounted on the billet carrier holder at that side thereof that is nearer the cylinder crosshead which device is operative with a shearing movement perpendicular to the press axis; a holding sleeve carried at the free end of the pivotable arm and thereby disposable adjacent to the billet carrier between the latter and the sealing stem, the holding sleeve being at least partly closed at its end remote from the billet carrier and being adapted to press against the billet carrier under pressure exerted by the sealing stem thereby to expel the sealing plate, the butt end of an extruded billet, and the extrusion die and die holder from the billet carrier into the holding sleeve, and having a lateral passage spaced from the sleeve end adjacent the billet carrier by a distance substantially equal to the length of the die holder and die and adapted to provide an exit passage for the butt end and sealing plate and an entrance for the shearing device to separate the butt end and sealing plate from the die holder and die and expel the butt end and sealing plate laterally from the sleeve; a support member in the lower region of and vertically coplanar with the billet carrier holder; and a support element on the holding sleeve arranged to rest on the support member when the sleeve is pivoted into the press axis, whereby the shearing device acts through said lateral passage on the sealing plate and butt end, against the die holder and die which are supported by the support member, support element and holding sleeve.

2. In an indirect extrusion press which comprises a press frame constituted by a cylinder crosshead, a counter-platen and tie members interconnecting this crosshead and counter-platen, billet carrier holder mounted for movement in the axial direction of the press frame, a billet carrier carried by the said holder, a movable crosshead mounted between the cylinder crosshead and the billet carrier holder and movable in the axial direction, a hollow die stem mounted on the counter-platen, extending towards the billet carrier and having a tip adapted to locate a die holder and extrusion die in the billet carrier, a sealing stem mounted on the moving crosshead, extending towards the billet carrier and having a tip adapted to locate a sealing plate in the billet carrier, at least one cylinder mounted on the cylinder crosshead with a piston movable in the cylinder for moving the movable crosshead, and means for moving the billet carrier holder, the improvement comprising: a shaft parallel to the axis of the press, a removal arm pivotable about said shaft and having a free end which by pivoting of the arm is movable to and away from the axis of the press, the arm being mounted for sliding independently on the said shaft parallel to the press axis; a shearing device mounted on the billet carrier holder at that side thereof that is nearer the cylinder crosshead which device is operative with a shearing movement perpendicular to the press axis; a holding sleeve carried at the free end of the pivotable arm and thereby disposable adjacent to the billet carrier between the latter and the sealing stem, the holding sleeve being at least partly closed at its end remote from the billet carrier and being adapted to press against the billet carrier under pressure exerted by the sealing stem thereby to expel the sealing plate, the butt end of an extruded billet, and the extrusion die and die holder from the billet carrier into the holding sleeve, comprising two axially adjacent parts namely a first part adjacent to the billet carrier for receiving the die holder and die, and a second part adjacent to the sealing stem for receiving the sealing plate and butt end, the first part being fast with the said arm and the second part being movable transversely relative to the first part; a support member in the lower region of and vertically coplanar with the billet carrier holder; and a support element on one of the arm and the said first part of the holding sleeve, arranged to rest on the support member when the sleeve is pivoted into the press axis; the shearing device being arranged to act on the butt end and sealing plate by way of the second part of the holding sleeve, moving the latter transversely relative to the first part of the sleeve for separating the butt end and sealing plate from the die holder and die received in the said first part, the said die holder and die being supported by the said first part, support element and support member.

3. The press of claim 2 in which the said second part of the holding sleeve is mounted on the said arm for pivoting transversely to the press axis.

4. The press of claim 2 in which the said second part of the holding sleeve is mounted on the said arm for sliding transversely to the press axis.

5. The press of claim 2 further including at least one hydraulic cylinder mounted on the said arm facing the billet carrier on that side of the latter that faces the movable crosshead said cylinder having a piston arranged to act on the said side of the billet carrier for moving the said arm in the axial direction of the press opposite the extrusion direction thereby to strip the said first part of the holding sleeve from the die holder and die.

6. The press according to any of claims 1 to 5 in which the said at least partly closed end of the holding sleeve adjacent the sealing stem has a central aperture, and an expulsion device is disposed in the press or sealing stem to enter the said aperture for expelling the extrusion from the die.

7. The press according to any of claims 1 to 5 in which the support element is adjustable in height.

8. The press according to any of claims 1 to 5 in which a clamping device is provided on the holding sleeve for clamping the die holder therein.

9. In an indirect extrusion process comprising placing a billet in a billet carrier having open front and rear ends, closing the rear end of the billet carrier by a sealing plate and holding the sealing plate in place by a sealing stem, disposing the front end of the billet carrier adjacent to an extrusion die and holding the die in place by a die holder on a hollow die stem, and moving the billet carrier over the die thereby extruding the billet through the die and leaving a butt end of the billet in the billet carrier after extrusion, pressure fluid-actuated cylinders being provided for effecting longitudinal movement of the sealing stem and longitudinal movement of the billet carrier relative to the die stem; the improvement comprising an operating method for freeing the die and die holder, butt end and sealing plate from the billet carrier, for shearing off the butt end and sealing plate, and for extracting the extruded piece after the extrusion operation, comprising the steps of:

after extrusion, disposing axially between the sealing stem and the sealing plate a holding sleeve which is at least partly closed at its end adjacent the sealing stem; pressing the billet carrier over the die stem by applying the available force of at least one said cylinder to the billet carrier through the sealing stem and holding sleeve whereby the sealing plate, butt end and the die and die holder enter the holding sleeve; the holding sleeve having a transverse opening with dimensions corresponding to the sealing plate and butt end which opening is spaced from that end of the sleeve adjacent the billet carrier by a distance corresponding to the length of the die holder and die; supporting the holding sleeve on an abutment fixed in relation to the billet carrier; advancing a shearing device into the said opening towards the said abutment perpendicular to the axis of the press thereby separating the sealing plate and butt end from the die and die holder and expelling the sealing plate and butt end from the sleeve, the said shearing device being mounted on a billet carrier holder provided for holding the billet carrier whereby the shearing reaction force is absorbed at the billet carrier holder by way of the holding sleeve and the said abutment; and gripping the die holder and moving it opposite the extrusion direction thereby stripping the die from the extruded workpiece.

10. In an indirect extrusion process comprising placing a billet in a billet carrier having open front and rear ends, closing the rear end of the billet carrier by a sealing plate and holding the sealing plate in place by a sealing stem, disposing the front end of the billet carrier adjacent to an extrusion die and holding the die in place by a die holder on a hollow die stem, and moving the billet carrier over the die thereby extruding the billet through the die and leaving a butt end of the billet in the billet carrier after extrusion, pressure fluid-actuated cylinders being provided for effecting longitudinal movement of the sealing stem and longitudinal movement of the billet carrier relative to the die stem; the improvement comprising an operating method for freeing the die and die holder, butt end and sealing plate from the billet carrier, for shearing off the butt end and sealing plate, and for extracting the extruded piece after the extrusion operation, comprising the steps of:

after extrusion, disposing axially between the sealing stem and the sealing plate a holding sleeve which comprises a first part adjacent the billet carrier and a second part adjacent the sealing stem and movable transversely relative to the first part, said second part being at least partly closed at its end adjacent the sealing stem and being adapted to receive the butt end and sealing plate, said first part being adapted to receive said die and die holder and the rear end of the extruded workpiece; applying the available force of at least one said cylinder through said sealing stem and holding sleeve to the billet carrier thereby pressing the billet carrier over the die stem and causing the sealing plate, butt end, die holder and die to enter the holding sleeve; supporting only the first part of the holding sleeve on an abutment which is fixed in relation to the billet carrier; advancing a shearing device into engagement with the second part of the holding sleeve in a direction perpendicular to the press axis thereby moving the said second part transversely relative to the said first part supported by the said abutment and thereby separating the sealing plate and butt end from the die holder, die and extruded workpiece, the shearing device being disposed on a billet carrier holder provided for holding the billet carrier whereby the shearing reaction force is absorbed at the billet carrier holder; gripping the die holder in the said first sleeve part and moving it opposite the extrusion direction thereby separating the die from the extruded workpiece.

11. An indirect metal extrusion press comprising apparatus for severing and removing an unextruded butt end portion of a billet, said press comprising:

(a) a billet carrier for carrying the billet and a billet carrier holder for holding the billet carrier;

(b) shearing means, mounted on the billet carrier holder, for severing the butt end;

(c) holding means for holding at least said butt end and receiving the force of the shearing means, comprising:

(d) a first holding sleeve adapted to be fixedly clamped about an extruded portion of the billet and removed after unclamping by means of a pivotable removal arm, to which sleeve the support member is fixed; and (e) a second holding sleeve removably clamped around said butt end and pivotably mounted on said removal arm of the first holding sleeve; so that the force of the shearing means is transmitted to the second holding sleeve severing the butt end from the extruded portion retained in the first holding sleeve and causing the second holding sleeve to pivot, the shearing force being transmitted through the pivoted mount of the second holding sleeve to the removal arm of the first holding sleeve and through it to the support member of the first holding sleeve; and wherein the shearing force received by the holding means is transmitted to the billet carrier holder by:

(f) a bracket member mounted in the lower region of, and vertically coplanar with, the billet carrier holder;

(g) a support member on the holding means arranged to rest on said bracket member when said holding sleeve is ready to receive the force of said shearing means.

* * * * *